US005080320A

United States Patent [19]

Chieng

[11] Patent Number: 5,080,320

[45] Date of Patent: Jan. 14, 1992

[54] ADJUSTABLE COMPUTER PRINTER STAND

[76] Inventor: Walter Chieng, No. 13, Lane 72, Lo-Yeh Street, Taipei, Taiwan

[21] Appl. No.: 630,198

[22] Filed: Dec. 19, 1990

[51] Int. Cl.[5] ..... A47F 5/00

[52] U.S. Cl. ..... 248/670; 211/13; 211/175; 248/172; 248/676

[58] Field of Search ..... 211/50, 13, 175; 248/670, 676, 172, 918, 678

[56] References Cited

U.S. PATENT DOCUMENTS

| | | | |
|---|---|---|---|
| 1,568,758 | 1/1926 | Malcolm | 248/172 X |
| 3,215,382 | 11/1965 | Stein | 248/172 |
| 4,332,366 | 6/1982 | Descals Munt | 248/670 |
| 4,512,543 | 4/1985 | Petrick | 248/670 |
| 4,651,967 | 3/1987 | McCoy | 248/676 |
| 4,722,506 | 2/1988 | Chang | 248/676 |
| 4,863,140 | 9/1989 | Schriner | 248/670 X |
| 4,938,447 | 7/1990 | Schriner | 248/676 X |

*Primary Examiner*—Robert W. Gibson, Jr.

*Attorney, Agent, or Firm*—Morton J. Rosenberg; David I. Klein

[57] ABSTRACT

An adjustable computer printer stand, which is comprised of a rectangular loading frame supported by four supports at four corners with a paper tray assembly mounted thereon. The loading frame is comprised of four L-shaped members partly sliding one inside another so that it can be adjusted transversely as well as longitudinally according to the size of an office machine to support. The paper tray assembly can be adjusted to a desired position and angle for orderly gathering continuous paper let off from a printer mounted on the loading frame.

4 Claims, 6 Drawing Sheets

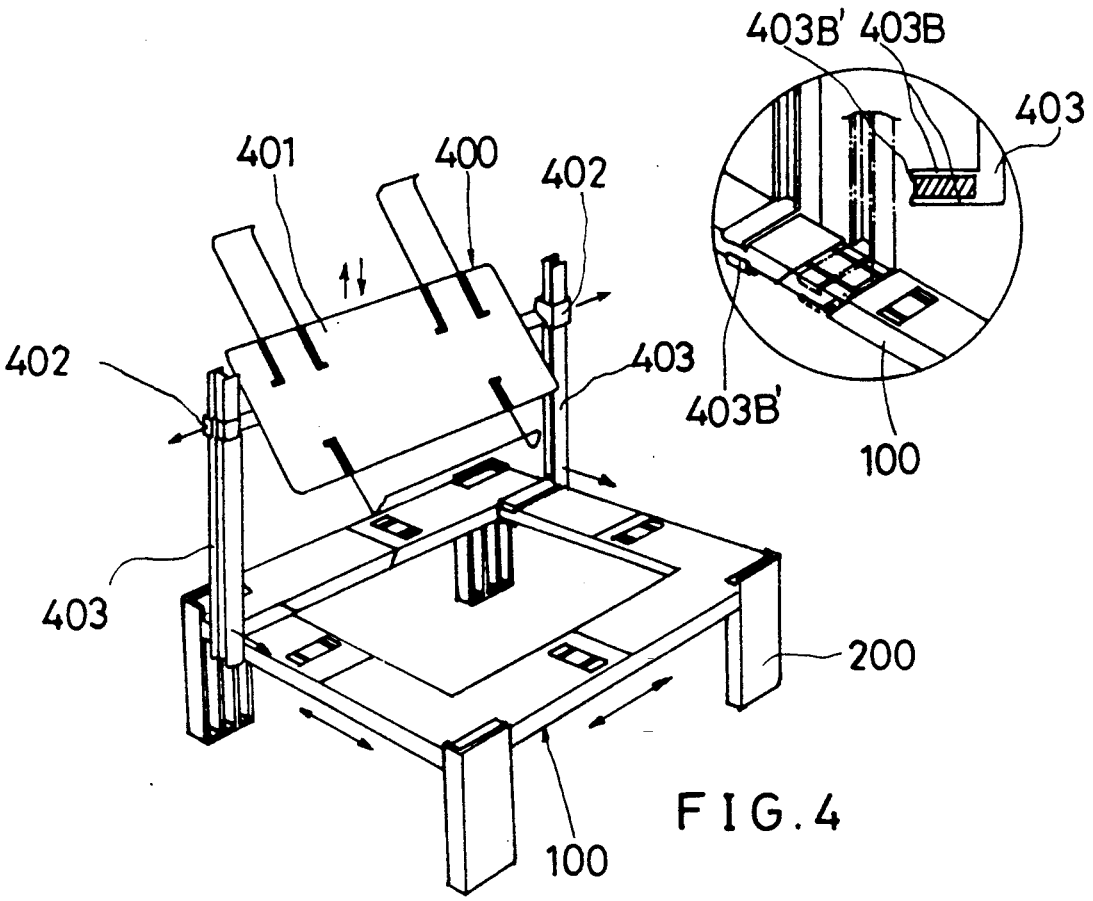
FIG. 4
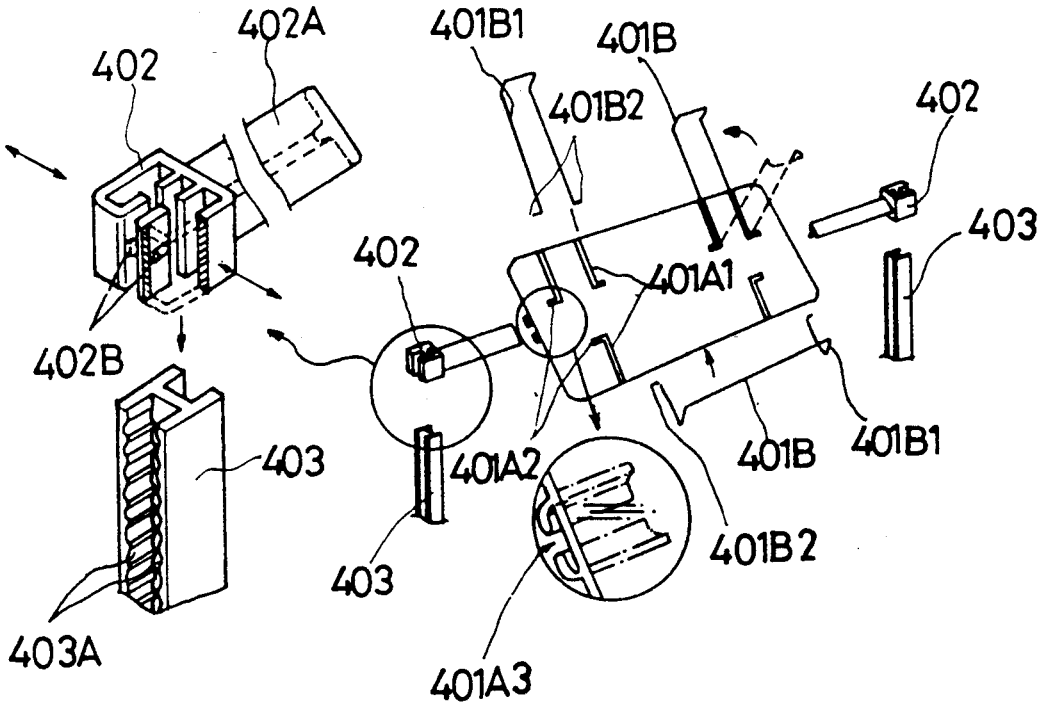
FIG 5a
FIG. 5

ADJUSTABLE COMPUTER PRINTER STAND

BACKGROUND OF THE INVENTION

The present invention relates to computer printer stands, and more particularly to an adjustable computer printer stand which can be conveniently adjusted according to the size of the computer printer to support.

Office automation has been greatly promoted everywhere in recent years. Therefore, a variety of office machines have been commonly used in offices. In installation of an office machine, heat dissipation problem must be taken into account, because it may affect the operation and service life of an office machine. Conventional office machine mounting stand is generally of fixed type and specifically designed for a specific model or type of machine. It does not have space designed for dissipating heat released from an office machine.

SUMMARY OF THE INVENTION

The present invention has been accomplished to eliminate the aforesaid problems. A printer stand of the present invention is generally comprised of a rectangular loading frame supported by four supports at four corners with a paper tray assembly mounted thereon for gathering continuous paper let off from a printer which is supported by the loading frame. The loading frame is comprised of four L-shaped members that partly slide one inside another. The L-shaped members comprise each a unitary tubing at one end, and a unitary, ⊓⊔⊔⊓ -shaped rod at an opposite end, wherein the tubing comprises a row of recessed holes and two parallel guide tracks on the inner wall and a window at the top; the ⊓⊔⊔⊓ -shaped rod has a plate spring at the top, which plate spring has a unitary hook at one end with a small, raised portion made thereon, and a set of graduation indicated thereon. Therefore, the shaped rod of one L-shaped member can slide along the guide tracks of the tubing of another L-shaped member permitting the raised portion on the hook to alternatively engage in the recessed holes on the tubing, or permitting the hook to hook in the window. The size of the loading frame after adjustment can be read out from the set of graduation through the window.

BRIEF DESCRIPTION OF THE DRAWINGS

The present invention will now be described by way of example only, with reference to the annexed drawings, in which:

FIG. 4 is a perspective view of the preferred embodiment of the present invention when paper tray is attached;

FIG. 5 is a perspective dismantled view of the paper tray according to the present invention;

DETAILED DESCRIPTION OF THE PREFERRED EMBODIMENT

Figure 1:
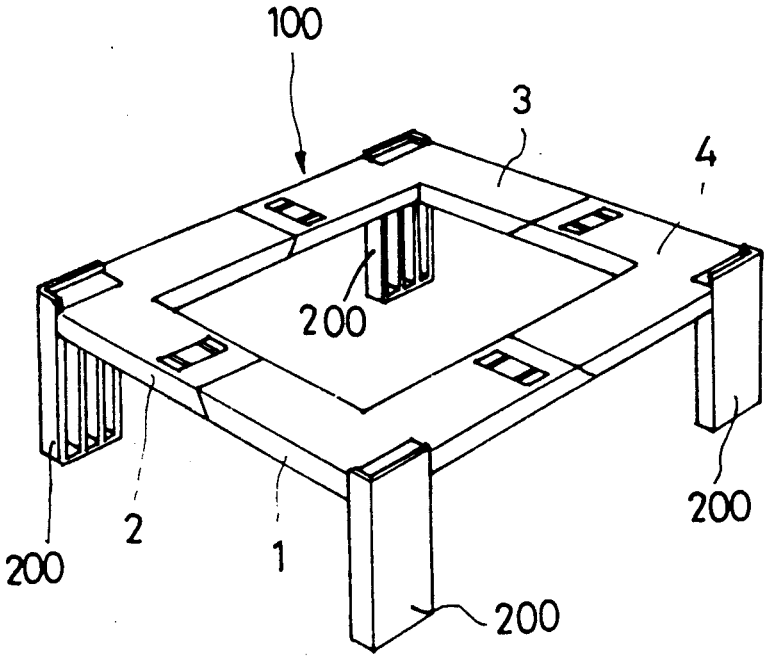
FIG. 1 is a perspective view of the preferred embodiment of computer printer stand (paper tray excluded) according to the present invention.
Figure 2:
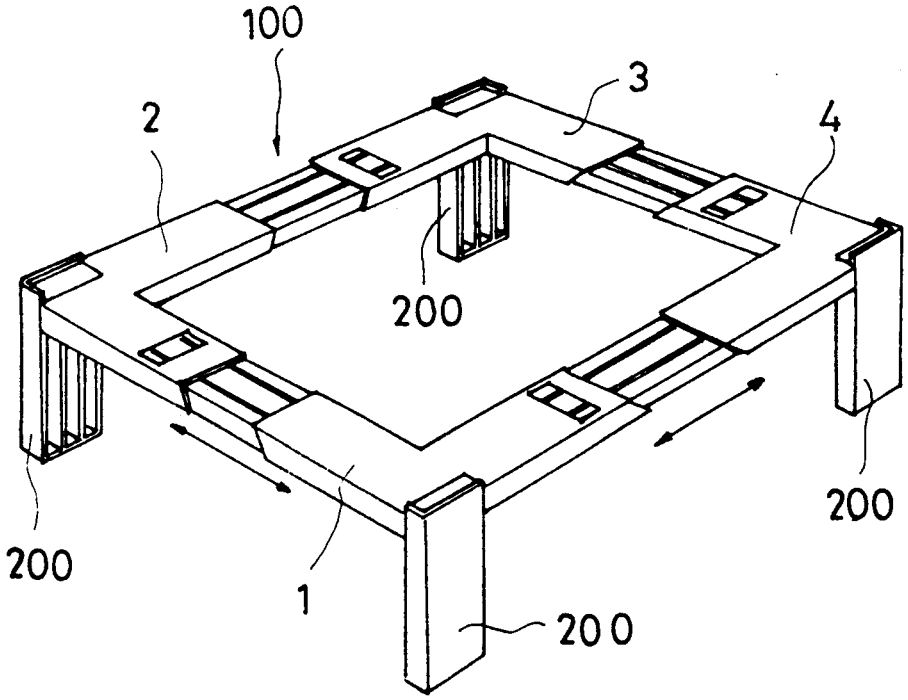
FIG. 2 illustrates the preferred embodiment of the present invention in an extended condition.
Figure 3:
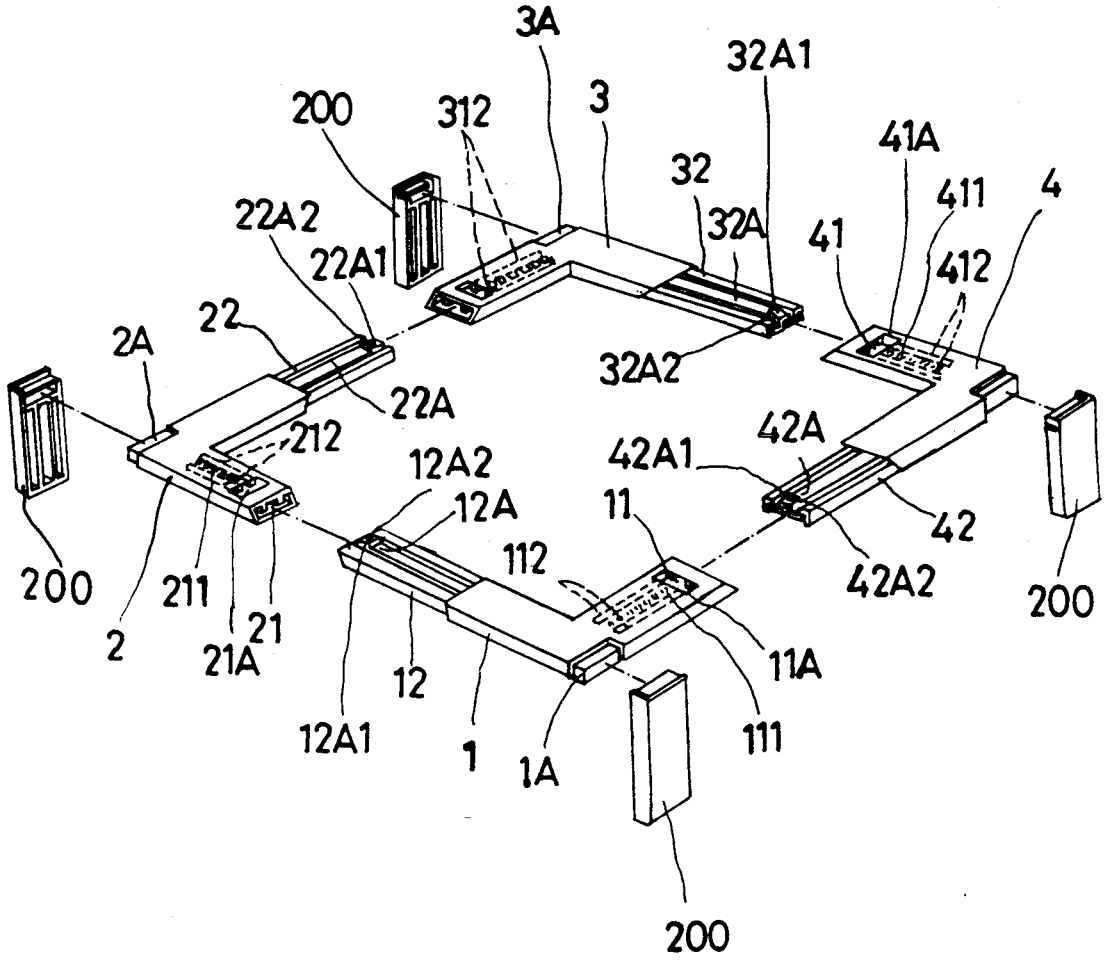
FIG. 3 is a perspective dismantled view of the preferred embodiment of the present invention.

Referring to FIGS. 1, 2 and 3, there is illustrated a computer printer stand embodying the present invention and generally comprised of a rectangular loading frame 100 supported by supports 200 at four corners. The loading frame 100 is comprised of four L-shaped members 1, 2, 3, 4, that partly slide one inside another. The L-shaped members are identical and comprise each a unitary tubing 11, 21, 31 or 41 at one end, and a unitary, ⊓⊔⊔⊓ -shaped rod 12, 22, 32 or 42 at an opposite end. There is a row of recessed holes 111, 211, 311 or 411 and two parallel guide tracks 112, 212, 312 or 412 respectively made on the inner wall of the tubing 11, 21, 31 or 41 at the top with the recessed holes disposed between the guide tracks, and a window 11A, 21A, 31A or 41A made on the tubing 11, 21, 31 or 41 at the top. There is a plate spring 12A, 22A, 32A, 42A made on the ⊓⊔⊔⊓-shaped rod 12, 22, 32 or 42, which comprises a unitary hook 12A1, 22A1, 32A1 or 42A1 at the front with a small, raised portion 12A2, 22A2, 32A2 or 42A2 made thereon. Therefore, the ⊓⊔⊔⊓-shaped rod 12, 22, 32 or 42 of one L-shaped member can be slided along the guide tracks 112, 212, 312 or 412 inside the tubing 11, 21, 31 or 41 of another L-shaped member. When the shaped rod 12, 22, 32 or 42 of one L-shaped member is inserted in the tubing 11, 21, 31 or 41 of another L-shaped member, the plate spring 12A, 22A, 32A or 42A is pressed downward permitting the raised portion 12A2, 22A2, 32A2 or 42A2 to alternatively engage in either one of the recessed holes 111, 211, 311 or 411. When two L-shaped members are connected together with the shaped rod 12, 22, 32 or 42 of one L-shaped member disposed inside the tubing 11, 21, 31 or 41 of the other and extended therefrom to the maximum, the hook 12A1, 22A1, 32A1 or 42A1 of one L-shaped member is hooked in the window 11A, 21A, 31A or 41A or the other L-shaped member, so that one L-shaped member is protected from disengaging from the other. Further, the loading frame 100 comprises four stub tenons 1A, 2A, 3A and 4A at the four corners thereof for mounting the four supports 200. Therefore, when a computer printer stand is set up, it can be flexibly adjusted (see FIG. 2) to suit different models of computer printers.

Figure 3A:
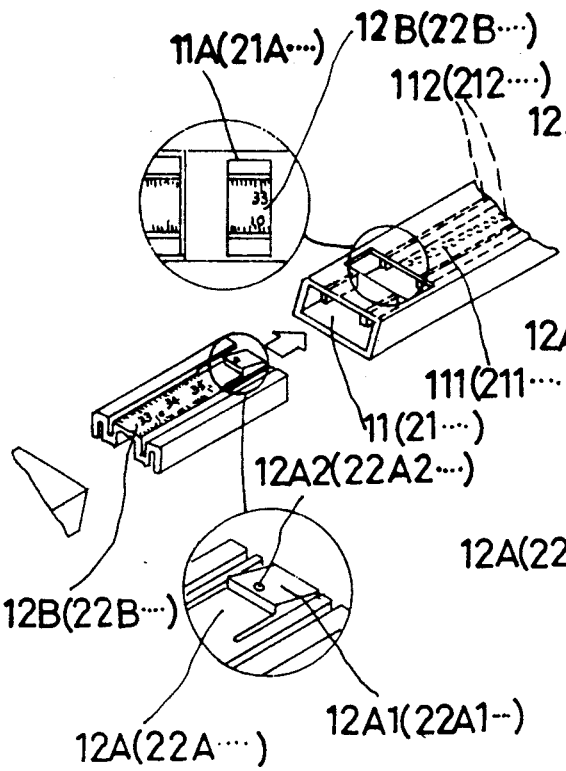
FIGS. 3*a*, 3*b*, 3*c*, 3*d*, 3*e* and 3*f* illustrate structural detail of the preferred embodiment of the present invention.
Figure 3B:
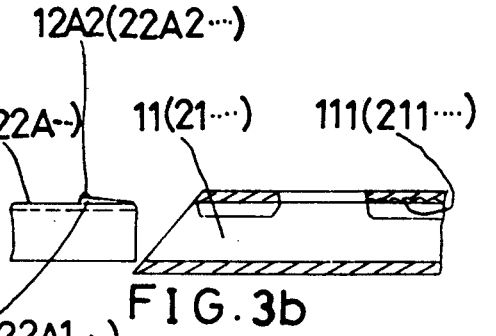

FIGS. 3A and 3B illustrate the connection of the tubing 11, 21, 31 or 41 with the rod 12, 22, 32 or 42. The raised portion 12A2, 22A2, 32A2 or 42A2 and the hook 12A1, 22A1, 32A1 or 42A1 are made on the plate spring 12A, 22A, 32A or 42A at the front end and follow the plate spring 12A, 22A, 32A or 42A to move up or down. The plate spring 12A, 22A, 32A or 42A further has a graduation 12B, 22B or 42B made thereon at the top. During assembly, the raised portion 12A2, 22A2, 32A2 or 42A2 is guided by the two guide tracks 112, 212, 312 or 412 to smoothly alternatively engage in the recessed holes (see FIG. 3B). Through the window 11A, 21A, 31A or 41A, the extending size of the loading frame 100 can be read out from the indication of the graduation 12B, 22B, 32B or 42B. As soon as the rod 12, 22, 32 or 42 is pulled out to the maximum extent, the plate spring 12A, 22A, 32A or 42A immediately springs off to force the hook 12A1, 22A1, 32A1 or 42A1 to hook in the window 11A, 21A, 31A or 41A so as to lock two connected L-shaped members in position.

Figure 3C:
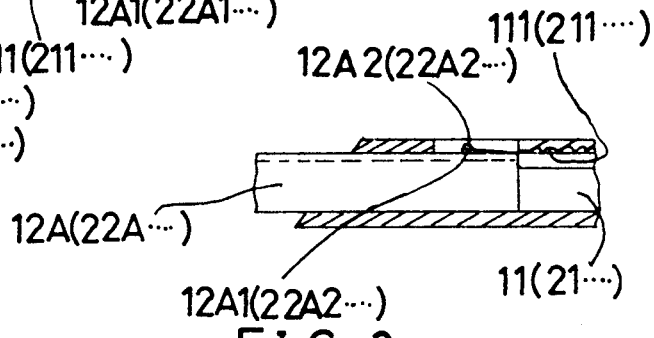
Figure 3D:
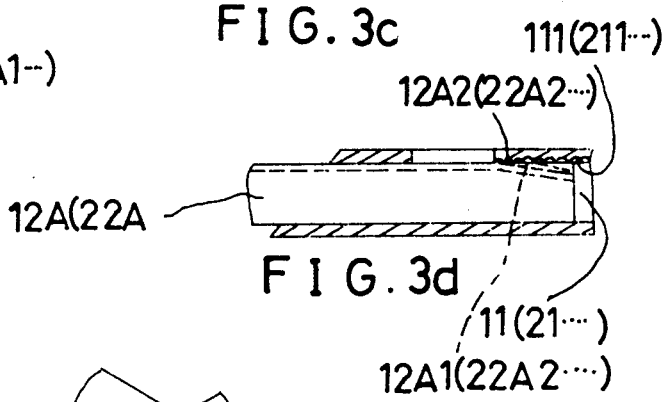
Figure 3E:
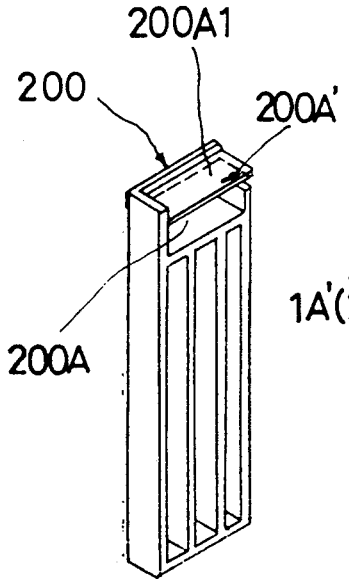
Figure 3F:
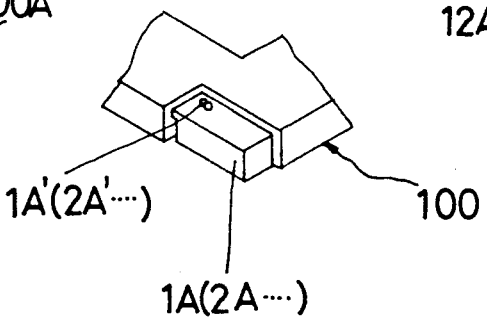

Referring to FIG. 3C, the supports 200 have each a stub mortise 200A at the top beneath a top board 200A1 which has a raised portion 200A1' on the bottom at location corresponding to the recess 1A', 2A', 3A' or 4A' made on the stub tenon 1A, 2A, 3A or 4A. During assembly, the stub tenons 1A, 2A, 3A and 4A are respectively fastened in the stub mortise 200A of the supports 200 permitting the raised portion 200A1' of the top board 200A1 of each support to respectively engage in the recess 1A', 2A' 3A' or 4A' of each stub tenon 1A, 2A, 3A or 4A.

Referring to FIGS. 4 and 5, a paper tray assembly 400 may be attached to the loading frame 100 for collecting paper. The paper tray assembly 400 is comprised of a paper tray 401 mounted on two supporting rods 403 by two slide blocks 402. The paper tray 401 is comprised of a rectangular board 401A and a plurality of brackets 401B. The rectangular board 401A has grooves 401A1 and mounting holes 401A2 for mounting the brackets 401B. The brackets 401B may be different in size, each of which is made of an iron wire and bent into such a shape that an U-shaped portion 401B1 is vertically disposed at the closed end, and two opposite hooked portions 401B2 are transversely bilaterally extending outwards at the open end. During assembly, the brackets 401B are respectively mounted on the grooves 401A1 of the rectangular board 401A with the hooked portions 401B2 respectively fastened in the mounting holes 401A2. Further, the paper tray 401 has two opposite slide ways 401A3 on the back at two opposite sides for sliding therein of a T-bar 402A which extends from the slide blocks 402 at one end. The slide blocks 402 have each a substantially ⊓⊔⊓ -shaped cross section defining therein a H-shaped space with small, raised stripes 402B made therein at two opposite locations. Because of the design of H-shaped space, the slide blocks 402 can be squeezed to deform.

The two supporting rods 403 are respectively made of a resilient I-bar, having each two opposite toothed inner wall portions 403A at one side for engaging with the raised stripes 402B of the slide blocks 402, and two pawl feet 403B transversely extending outward at one end. The pawl feet 403B have each a hooked end 403B' convenient for fastening in the loading frame 100.

Figure 6:
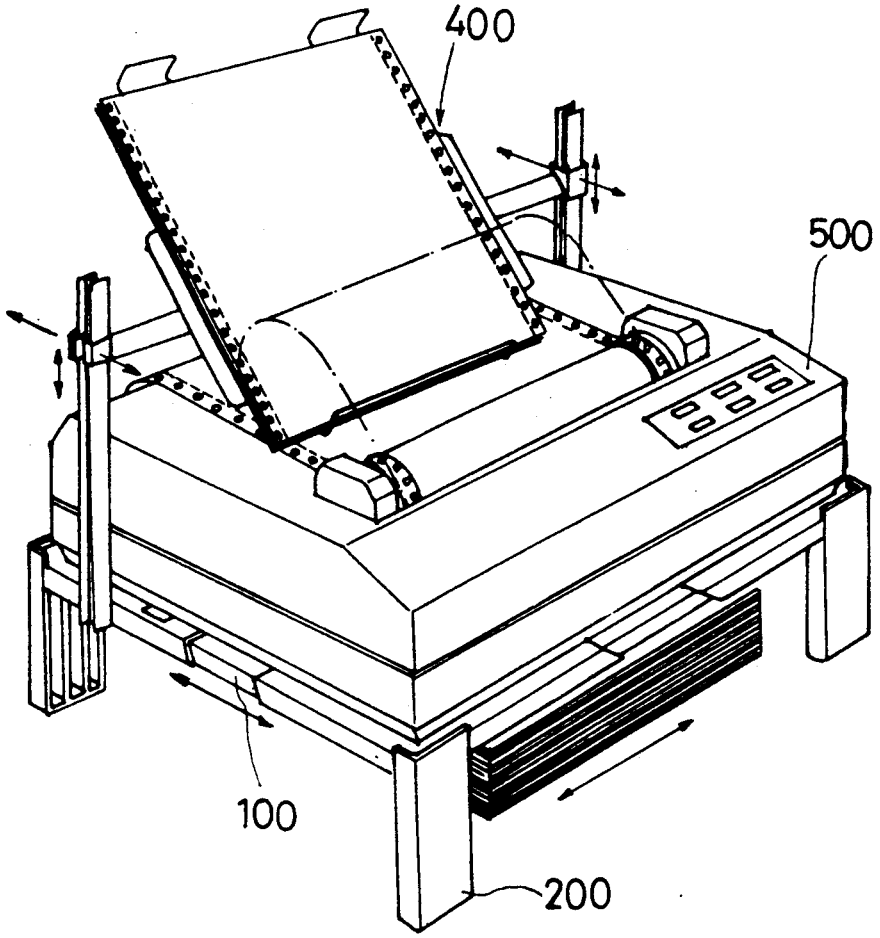
FIG. 6 illustrates the outer appearance of the preferred embodiment of the present invention during printing operation.
Figure 7:
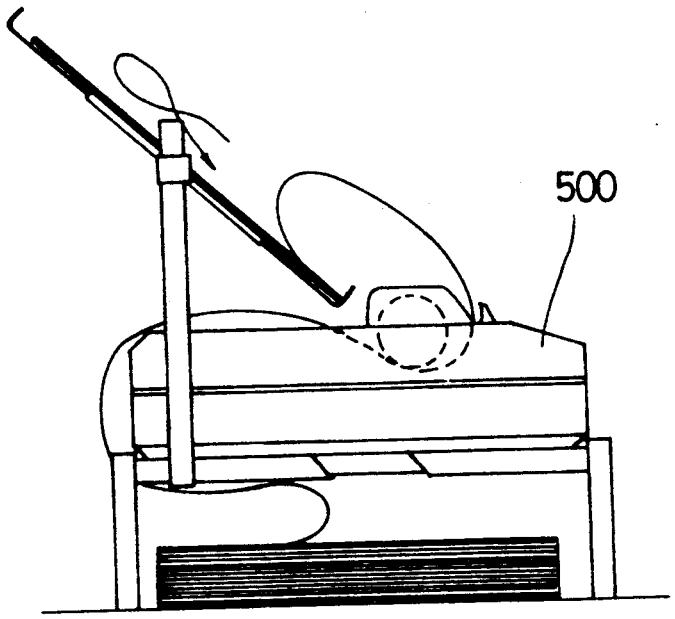
FIG. 7 is a side view of the preferred embodiment of the present invention showing the paper path.

Referring to FIGS. 6 and 7, the loading frame 100 is properly adjusted according to the size of the printer 500 loaded. The paper tray assembly 400 is also properly adjusted to the best fit position and angle for collecting continuous paper orderly. During collection of let-off paper, proofreading can be conveniently performed.

Figure 8:
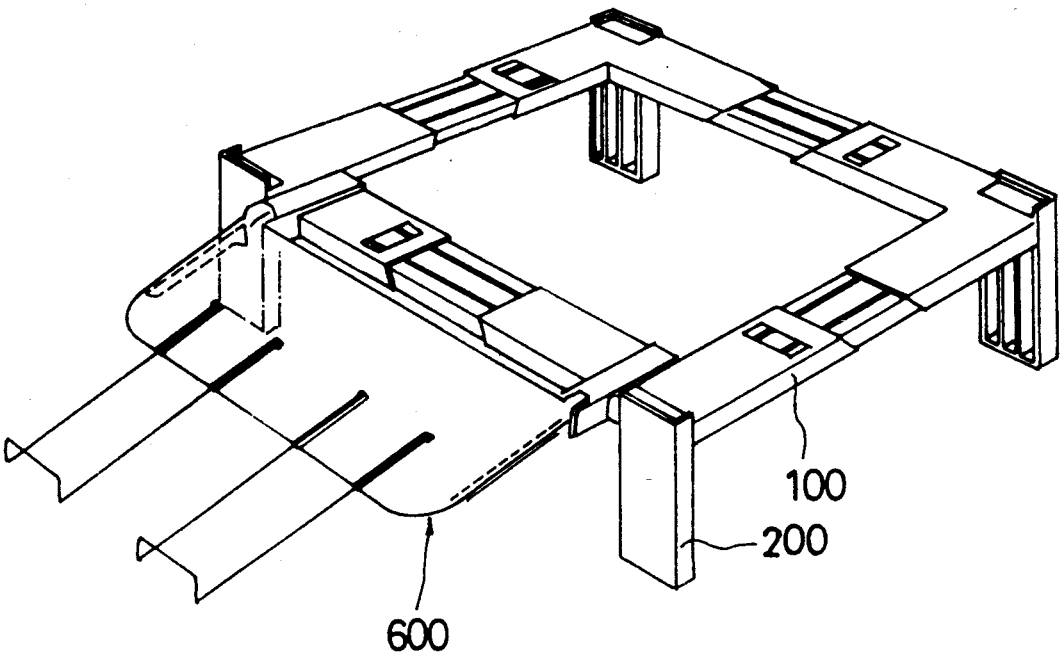
FIG. 8 illustrates an alternate form of paper tray according to the present invention.
Figure 9:
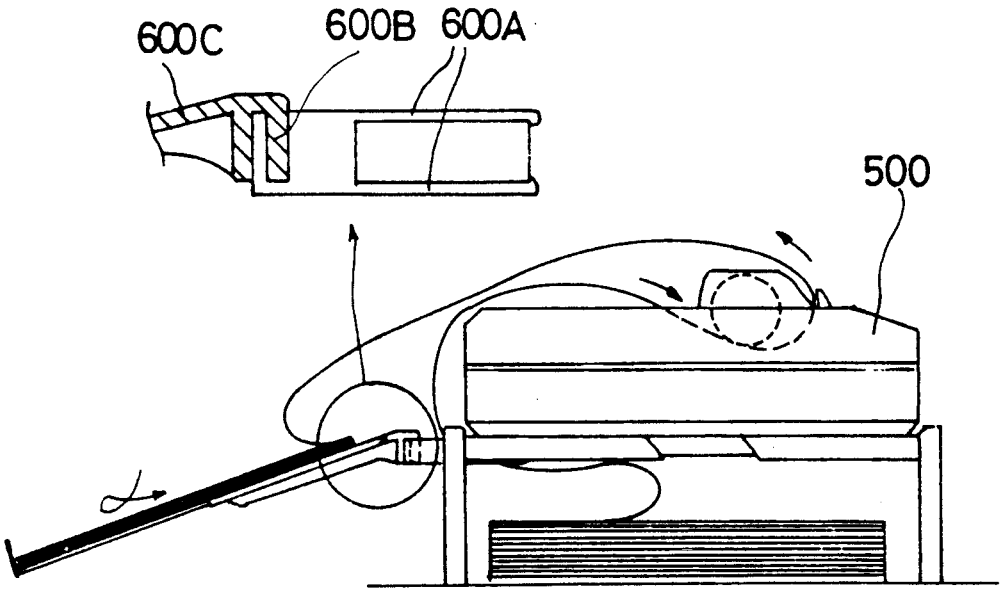
FIG. 9 is a side view taken on FIG. 8, showing a different paper path.

Referring to FIGS. 8 and 9, there is illustrated an alternate form of paper tray assembly according to the present invention. As illustrated, two seat members 600 are mounted on the loading frame 100 at two opposite ends on the same side for mounting a paper tray 600C. The seat members 600 have each a resilient retainer end 600A for fastening in the loading frame 100, and a blind hole 600B into which the hooked end of the paper tray 600C is fastened. After installation, let-off paper from printer 500 is gathered at on the paper tray at the back side.

What is claimed is:

1. A printer stand comprising:

a rectangular loading frame supported by four support members positionally located at the four corners of said rectangular loading frame and having a paper tray assembly mounted thereon, said rectangular loading frame including four L-shaped members at least partially slidingly insertable one within another for longitudinal and transverse dimension adjustability, said L-shaped members being substantially identical in contour, each of said L-shaped members including a unitary tube member on a first end and a unitary substantially W-shaped rod member on an opposing second end, said tube member comprising a row of recessed holes formed therein and a pair of parallel guide tracks formed within an inner wall, said tube member further including a window section formed within a top wall thereof, each said substantially W-shaped rod member having a plate spring secured to said top wall, said plate spring having a unitary hook formed on one end thereof with a set of indicia graduations, said unitary hook having a raised portion and characterized in that said substantially W-shaped rod member of one of said L-shaped members is slidingly engageable within said guide tracks of said tube member of another one of said L-shaped members to allow said raised portion to alternatively engage (1) within said recessed holes, and (2) said hook within said window whereby the dimensional size of said loading frame subsequent to adjustment may be viewed from said set of graduated indicia through said window.

2. The printer stand as recited in claim 1 wherein said support member each have a stub mortise at a top section beneath a top board, said top board having a raised portion on a bottom section, said loading frame having four stub tenons at four corners for insertion into the stub mortise of said support members, said stub tenons each having a recess formed therein into which the raised portion of said top board is engaged.

3. The printer stand of claim 1, wherein said paper tray assembly is comprised of a paper tray mounted on two supporting rods by two slide blocks, said paper tray comprised of a rectangular board and a plurality of brackets, said rectangular board having grooves and mounting holes for mounting said brackets, said brackets each having an U-shaped portion vertically disposed at an closed end and two opposite hooked portions transversely bilaterally extending outwards at an open end, said hooked portions being respectively fastened in said mounting holes, said paper tray having two opposite slide ways on the back at two opposite sides, said slide blocks having each a T-bar extending from a body at one end and fastened to slide in said slide ways, said body having a substantially inverted U-shaped cross section defining therein a H-shaped space with small, raised stripes made therein at two opposite locations, said supporting rods being each made of a resilient I-bar having two opposite toothed inner wall portions at one side for engaging with said raised stripes, and two pawl feet transversely extending outward at one end, said pawl feet having each a hooked end fastening in said loading frame, and characterized in that said paper tray can be adjusted horizontally and vertically to an angular position suitable for orderly collecting continuous paper exiting from a printer mounted on said loading frame.

4. The printer stand cf claim 1, wherein said paper tray comprises two seat members mounted on said loading frame at two opposite ends on the same side for holding a paper tray, said seat members having each a resilient retainer end fastened in said loading frame, and a blind hole for fastening said paper tray, said paper tray having a hooked end fastened in said blind hole.

* * * * *